US007790020B2

(12) United States Patent
Kokayeff et al.

(10) Patent No.: US 7,790,020 B2
(45) Date of Patent: Sep. 7, 2010

(54) HYDROCARBON CONVERSION PROCESS TO IMPROVE CETANE NUMBER

(75) Inventors: Peter Kokayeff, Des Plaines, IL (US); Laura Elise Leonard, Des Plaines, IL (US); Michael Roy Smith, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 171 days.

(21) Appl. No.: 11/872,102

(22) Filed: Oct. 15, 2007

(65) Prior Publication Data

US 2009/0095656 A1 Apr. 16, 2009

(51) Int. Cl.
*C10G 45/44* (2006.01)
*C10G 65/02* (2006.01)

(52) U.S. Cl. ..... 208/212; 208/49; 208/89; 208/143

(58) Field of Classification Search ..... 208/49, 208/208 R, 209, 212, 216, 89, 142–143
See application file for complete search history.

(56) References Cited

U.S. PATENT DOCUMENTS

| | | | | |
|---|---|---|---|---|
| 3,130,006 A | | 4/1964 | Rabo et al. | 23/110 |
| 3,668,112 A | | 6/1972 | Parker et al. | 208/89 |
| 4,363,718 A | | 12/1982 | Klotz | 208/110 |
| 4,676,887 A | | 6/1987 | Fischer et al. | 208/61 |
| 4,738,766 A | | 4/1988 | Fischer et al. | 208/68 |
| 4,789,457 A | | 12/1988 | Fischer et al. | 208/68 |
| 4,828,677 A | | 5/1989 | Fischer et al. | 208/89 |
| 4,919,789 A | | 4/1990 | Fischer et al. | 208/61 |
| 4,943,366 A | | 7/1990 | Fischer et al. | 208/68 |
| 5,114,562 A | * | 5/1992 | Haun et al. | 208/89 |

(Continued)

FOREIGN PATENT DOCUMENTS

EP 0 993 498 B1 8/2004

(Continued)

OTHER PUBLICATIONS

Schmitz, C. et al, "Deep desulfurization of diesel oil: Kinetic studies and process-improvement by the use of a two-phase reactor with pre-saturator," Chemical Engineering Science, vol. 59, No. 14, 2004, pp. 2821-2829.

(Continued)

*Primary Examiner*—Walter D Griffin
*Assistant Examiner*—Renee Robinson
(74) *Attorney, Agent, or Firm*—James C Paschall

(57) ABSTRACT

A process is provided for producing low sulfur diesel having a high cetane number where the temperature and pressure requirements for obtaining low levels of sulfur is separated from the temperature and pressure requirements for improving cetane. In one aspect, a low pressure hydrodesulfurization zone and a high pressure aromatic saturation zone are employed to sequentially achieve the desired sulfur and cetane levels. In another aspect, the process first converts a diesel boiling range hydrocarbonaceous stream in a hydrotreating zone at conditions effective to produce a hydrotreating zone effluent having a reduced concentration of sulfur with minimal saturation of aromatics. Hydrogen is then admixed with the hydrotreating zone effluent, which is then reacted in a substantially liquid-phase continuous reaction zone substantially undiluted with other streams to effect saturation of aromatics to provide a liquid-phase continuous reaction zone effluent having an improved cetane number.

20 Claims, 1 Drawing Sheet

U.S. PATENT DOCUMENTS

| | | | | |
|---|---|---|---|---|
| 5,403,470 | A | 4/1995 | Kokayeff et al. | 208/212 |
| 5,527,448 | A | 6/1996 | Morel et al. | 208/211 |
| 5,718,820 | A | 2/1998 | Morel et al. | 208/15 |
| 6,123,835 | A | 9/2000 | Ackerson et al. | 208/213 |
| 6,200,462 | B1 | 3/2001 | Cash et al. | 208/89 |
| 6,221,239 | B1 * | 4/2001 | Morel et al. | 208/89 |
| 6,294,080 | B1 | 9/2001 | Thakkar et al. | 208/100 |
| 6,428,686 | B1 | 8/2002 | Ackerson et al. | 208/213 |
| 6,444,116 | B1 | 9/2002 | Galiasso et al. | 208/58 |
| 6,497,813 | B2 | 12/2002 | Ackerson et al. | 208/311 |
| 6,638,419 | B1 | 10/2003 | Da Silva et al. | 208/208 R |
| 6,881,326 | B2 | 4/2005 | Ackerson et al. | 208/213 |
| 6,890,425 | B2 | 5/2005 | Ackerson et al. | 208/311 |
| 7,094,332 | B1 | 8/2006 | Kalnes et al. | 208/97 |
| 2005/0010076 | A1 | 1/2005 | Wasserscheid et al. | 585/862 |
| 2005/0082202 | A1 | 4/2005 | Ackerson et al. | 208/213 |
| 2006/0144756 | A1 | 7/2006 | Ackerson et al. | 208/108 |

FOREIGN PATENT DOCUMENTS

WO WO 00/34416 * 6/2000

OTHER PUBLICATIONS

Datsevitch, L. et al., "Improvement of the deep desulfurization of diesel fuel by pre-saturation and a recycle of the liquid phase," DGMK Tagungsber., 2003, pp. 321-328, Chemical Abstracts 140(15/16), Abstract No. 255917 (2004).

Gudde, N.J. et al., "Improving deep sulfur removal from motor fuels by the use of a pre-saturator and a liquid circuit," Chemie-Ingenieur-Technik, vol. 75, No. 8, 2003, p. 1040, and English language abstract (1 page).

Boesmann, A. et al., "Deep desulfurization of diesel fuel by extraction with ionic liquids," Chem. Commun., vol. 23, 2001, pp. 2494-2495, Chemical Abstracts 136(9/10), Abstract No. 153666 (2002).

Stratiev, D. et al., "Investigation on the effect of heavy diesel fraction properties on product sulphur during ultra deep diesel hydrodesulphurization," Erdol Erdgas Kohle, vol. 122, No. 2, 2006, pp. 59-60, 62-63, Urban Verlag Hamburg/Wien GmbH, Germany.

Gatte, R. et al., "Hydrogen processing. Hydrotreating. General Process.", National Petrochemical and Refiners Association, 1999 NPRA Question and Answer Session on Refining and Petrochemical Technology, Washington, D.C., pp. 140-158.

Johnson, T.E., "Weigh options for meeting future gasoline sulfur specifications," Fuel Technology & Management, vol. 7, No. 2, pp. 16,18 (Mar. 1997).

U.S. Appl. No. 11/300,007, filed Dec. 14, 2005, Leonard.

U.S. Appl. No. 11/460,307, filed Jul. 27, 2006, Leonard.

U.S. Appl. No. 11/618,623, filed Dec. 29, 2006, Kokayeff.

U.S. Appl. No. 11/872,140, filed Oct. 15, 2007, Kokayeff.

U.S. Appl. No. 11/872,084, filed Oct. 15, 2007, Leonard.

U.S. Appl. No. 11/872,251, filed Oct. 15, 2007, Kokayeff.

U.S. Appl. No. 11/872,312, filed Oct. 15, 2007, Kokayeff.

U.S. Appl. No. 12/165,444, filed Jun. 30, 2008, Petri.

U.S. Appl. No. 12/165,499, filed Jun. 30, 2008, Kokayeff.

U.S. Appl. No. 12/165,522, filed Jun. 30, 2008, Kokayeff.

U.S. Appl. No. 12/495,574, filed Jun. 30, 2009, Petri.

U.S. Appl. No. 12/495,601, filed Jun. 30, 2009, Petri.

Office Action dated Jun. 4, 2009 in U.S. Appl. No. 11/460,307, Leonard.

Office Action dated Jun. 12, 2009 in U.S. Appl. No. 11/618,623, Kokayeff.

* cited by examiner

HYDROCARBON CONVERSION PROCESS TO IMPROVE CETANE NUMBER

FIELD

The field generally relates to a hydrocarbon conversion process for the production of low or ultra low sulfur diesel having a high cetane number. In particular, the process relates to a hydrocarbon conversion process including a substantially liquid-phase continuous reaction zone.

BACKGROUND

To prepare saleable petroleum fuels, refiners generally need to satisfy a variety of governmental regulations and industry standards relative to various components and characteristics of the fuel. Sulfur levels and cetane number are two such characteristics commonly monitored during diesel fuel refining. Regarding sulfur content, new requirements for ultra low sulfur diesel (ULSD) typically require less than about 10 wppm sulfur. Regarding cetane numbers, it is generally desired to have a diesel fuel with a cetane number greater than about 40, and in some cases, from about 40 to about 60. A higher cetane number generally correlates to a higher quality diesel fuel.

Current refining processes to achieve both low levels of sulfur and high cetane numbers can be complex, expensive, and require large amounts of high pressure hydrogen. For example, a mild hydrocracking unit, which typically includes a hydrotreating zone and a hydrocracking zone, is one method to produce diesel boiling range hydrocarbons with a reduced level of sulfur from a vacuum gas oil or other feed stream. However, the typical mild hydrocracking unit generally cannot produce diesel meeting the ultra low sulfur requirements with acceptable cetane numbers. In many cases, the product from a common mild hydrocracking unit still has about 100 to about 2000 wppm of sulfur and a relatively low cetane number of about 30 to about 40.

Further processing or increasing the severity of the hydrotreating process to achieve lower levels of sulfur and higher cetane generally over treats the higher boiling components and requires additional high pressure vessels. Overtreated higher boiling components are generally not suitable for subsequent fluid catalytic cracking. Additional high pressure vessels require a large capital investment and are more costly to operate. Moreover, the additional or modified reactors in these units typically incorporate three-phase (gas/liquid/solid catalyst) trickle bed reactors that have large hydrogen requirements in order to maintain a continuous gas-phase throughout the reactors. Increasing the pressure of such units typically also requires a costly, high-pressure recycle gas compressor in order to provide the large hydrogen volumes at higher pressures. For example, a typical high-pressure, three-phase reaction vessel added to a mild hydrocracking unit would require a relatively large portion of the hydrogen recycle gas (up to about 10,000 SCF/B, for instance) to be processed through a high pressure compressor. Such units add further complexity, capital investment, and operating costs to such systems.

A distillate hydrotreating unit, which is designed to process a particular distillate product such as a straight run diesel, is another process to produce diesel boiling range hydrocarbons with a reduced level of sulfur. While the distillate hydrotreating unit can be configured to meet both low sulfur and high cetane specifications, the hydrotreating zone must operate at high pressure, such as about 6.9 MPa (1000 psig) or greater, to achieve both specifications. A three-phase distillate hydrotreating unit at such pressure also requires large hydrogen volumes to maintain the continuous gas-phase. Such large volumes of hydrogen would also need to be processed through a costly recycle gas compressor, and further requires upgrading the reaction vessels to withstand the high pressures.

Two-phase hydroprocessing (i.e., a liquid hydrocarbon stream and solid catalyst) also has been proposed to convert certain hydrocarbonaceous streams into other more valuable hydrocarbon streams in some cases. For example, the reduction of sulfur in certain hydrocarbon streams may employ a two-phase reactor with pre-saturation of hydrogen rather than using a traditional three-phase system. See, e.g., Schmitz, C. et al., "Deep Desulfurization of Diesel Oil: Kinetic Studies and Process-Improvement by the Use of a Two-Phase Reactor with Pre-Saturator," Chem. Eng. Sci., 59:2821-2829 (2004).

These two-phase systems only use enough hydrogen to saturate the liquid-phase in the reactor. As a result, the reaction systems of Schmitz et al. do not provide for decreasing hydrogen levels due to hydrogen consumption during the reaction process, thus the reaction rate in such systems decreases due to the depletion of the dissolved hydrogen. As a result, such two-phase systems as disclosed in Schmitz et al. are limited in practical application and in maximum conversion rates.

Other uses of liquid-phase reactors to process hydrocarbonaceous streams require the use of diluent/solvent streams to aid in the solubility of hydrogen in the unconverted oil feed. For example, liquid-phase hydrotreating of a diesel fuel has been proposed, but requires a recycle of hydrotreated diesel as a diluent blended into the feed of the liquid-phase reactor. In another example, liquid-phase hydrocracking of vacuum gas oil is proposed, but likewise requires the recycle of hydrocracked product into the feed of the liquid-phase hydrocracker as a diluent.

Because hydrotreating and hydrocracking typically require large amounts of hydrogen to effect their conversions, a large hydrogen supply is still required even if these reactions are completed in liquid-phase systems. As a result, to maintain such a liquid-phase hydrotreating or hydrocracking reaction in such systems and still provide the needed levels of hydrogen, such prior liquid-phase systems require the introduction of additional diluents or solvents to dilute the reactive components of the feed. In such systems, the diluents and solvents provide capacity for a larger concentration of dissolved hydrogen in the stream relative to the now diluted reactive components in the feed to insure adequate conversion rates can occur in the liquid-phase. Larger, more complex, and more expensive liquid-phase reactors are needed in these systems to achieve the desired conversions.

Although a wide variety of process flow schemes, operating conditions and catalysts have been used in commercial petroleum hydrocarbon conversion processes, there is always a demand for new methods and flow schemes that provide more useful products and improved product characteristics. In many cases, even minor variations in process flows or operating conditions can have significant effects on both quality and product selection. There generally is a need to balance economic considerations, such as capital expenditures and operational utility costs, with the desired quality of the produced products.

SUMMARY

A process is provided to produce a low, and preferably, an ultra low sulfur diesel having a high cetane number. In one aspect, a diesel boiling range hydrocarbon stream with a sulfur content, a cetane number, and an aromatic content is reacted in at least a hydrotreating zone having at least a hydrodesulfurization catalyst and at hydrotreating conditions effective to produce a hydrotreating zone effluent having a reduced sulfur content relative to the diesel boiling range hydrocarbon stream. In another aspect, an amount of hydrogen then is admixed with the hydrotreating zone effluent or at least a portion of the hydrotreating zone effluent. Preferably, the hydrogen is in an amount and a form available for substantially consistent consumption in a substantially liquid-phase continuous reaction zone. In another aspect, the hydrotreating zone effluent (or portion thereof), which is preferably substantially undiluted with other hydrocarbon streams (such as, for example, a recycle of a liquid phase effluent, other hydrocarbonaceous streams, and/or other hydroprocessed streams having increased cetane numbers), is then reacted in the substantially liquid-phase continuous hydroprocessing or reaction zone over a catalyst and at conditions effective to saturate at least a portion of the aromatic content therein to provide a liquid-phase continuous reaction zone effluent having an improved cetane number over the diesel boiling range hydrocarbon stream.

In such aspect, a low sulfur diesel with a high cetane number is provided from a process that generally separates the temperatures and pressures to desulfurize from the temperatures and pressures to improve cetane. For example, the processes herein generally use low pressures in the hydrotreating zone to first desulfurize the feed and then employ higher pressures in the substantially liquid-phase continuous reaction zone to saturate aromatics of the previously desulfurized feed to improve cetane.

In another aspect, a vapor phase of lighter components in the hydrotreating zone effluent is first separated from the feed to the substantially liquid-phase reactors. Therefore, only a portion of the hydrocarbons processed through the hydrotreating zone are subsequently reacted in the liquid-phase so that the substantially liquid-phase continuous reaction zone is generally smaller than the hydrotreating reaction zone. In such aspect, the processes herein provide for a much smaller portion of the flow scheme to operate at higher pressures. As a result, the processes herein preferably eliminate the need for a high pressure hydrotreater and avoid the need for large volumes of high pressure hydrogen and the associated costly, high-pressure recycle gas compressor.

In another aspect, the substantially liquid-phase continuous reaction zone also operates without a hydrogen recycle, other hydrocarbon recycle streams, or admixing other hydrocarbons into the liquid-phase feed because sufficient hydrogen can be supplied into the substantially liquid-phase reactor to improve cetane number without diluting the reactive components of the feed. In such aspect, the hydrotreating zone effluent (or portion thereof directed to the liquid-phase zone) is generally without a substantial hydrocarbon content provided from the substantially liquid-phase continuous reaction zone. Diluting or recycling streams into the feed of the liquid-phase continuous phase reaction zone would generally decrease the conversion per pass and, therefore, generally necessitate a larger reaction zone and higher hydrogen demands to achieve the same desired improvement in cetane due to the additional volume from the recycle streams or other diluent.

In another aspect, the hydrotreating zone effluent or portion thereof (i.e., feed stream to the liquid-phase continuous reaction zone) is admixed with an amount of hydrogen to saturate the hydrotreating zone effluent. In a preferred aspect, the hydrotreating zone effluent (or portion thereof) is admixed with an amount of hydrogen in excess of that required for saturation. By this approach, the liquid-phase is substantially saturated with hydrogen throughout the reactor as the reaction proceeds. In other words, as the reactions consume dissolved hydrogen, the liquid-phase remains saturated so that additional hydrogen is continuously available from a small gas-phase entrained or otherwise associated with the liquid-phase to dissolve back into the liquid-phase to maintain the substantially constant level of saturation.

Thus, in this aspect, the liquid-phase preferably has a generally constant level of dissolved hydrogen from one end of the reactor zone to the other. The excess hydrogen, present as bubbles dispersed throughout the liquid-phase, allows the liquid-phase reactors to be operated at a substantially constant reaction rate to generally provide higher conversions per pass and permits the use of smaller reactor vessels. The constant replenishment of hydrogen into the liquid phase results in higher reaction rates and, in one aspect, allows the substantially liquid-phase continuous reaction zone to operate without a liquid recycle to achieve the desired cetane numbers.

In yet another aspect, the hydrogen can be supplied to the substantially liquid-phase reactors through a slip stream from a make-up hydrogen system, and generally avoid the use of costly recycle gas compressors. In this aspect, the substantially liquid-phase continuous reaction zone preferably operates without additional or other external sources or hydrogen where the entire hydrogen demand for the substantially liquid-phase continuous reaction zone is provided from the make-up hydrogen system into the feed of the liquid-phase continuous reaction zone.

Other embodiments encompass further details of the process, such as preferred feed stocks, preferred hydrotreating catalysts, preferred liquid-phase catalysts, and preferred operating conditions to provide but a few examples. Such other embodiments and details are hereinafter disclosed in the following discussion of various aspects of the process.

DETAILED DESCRIPTION OF THE PREFERRED EMBODIMENT

Figure 1:
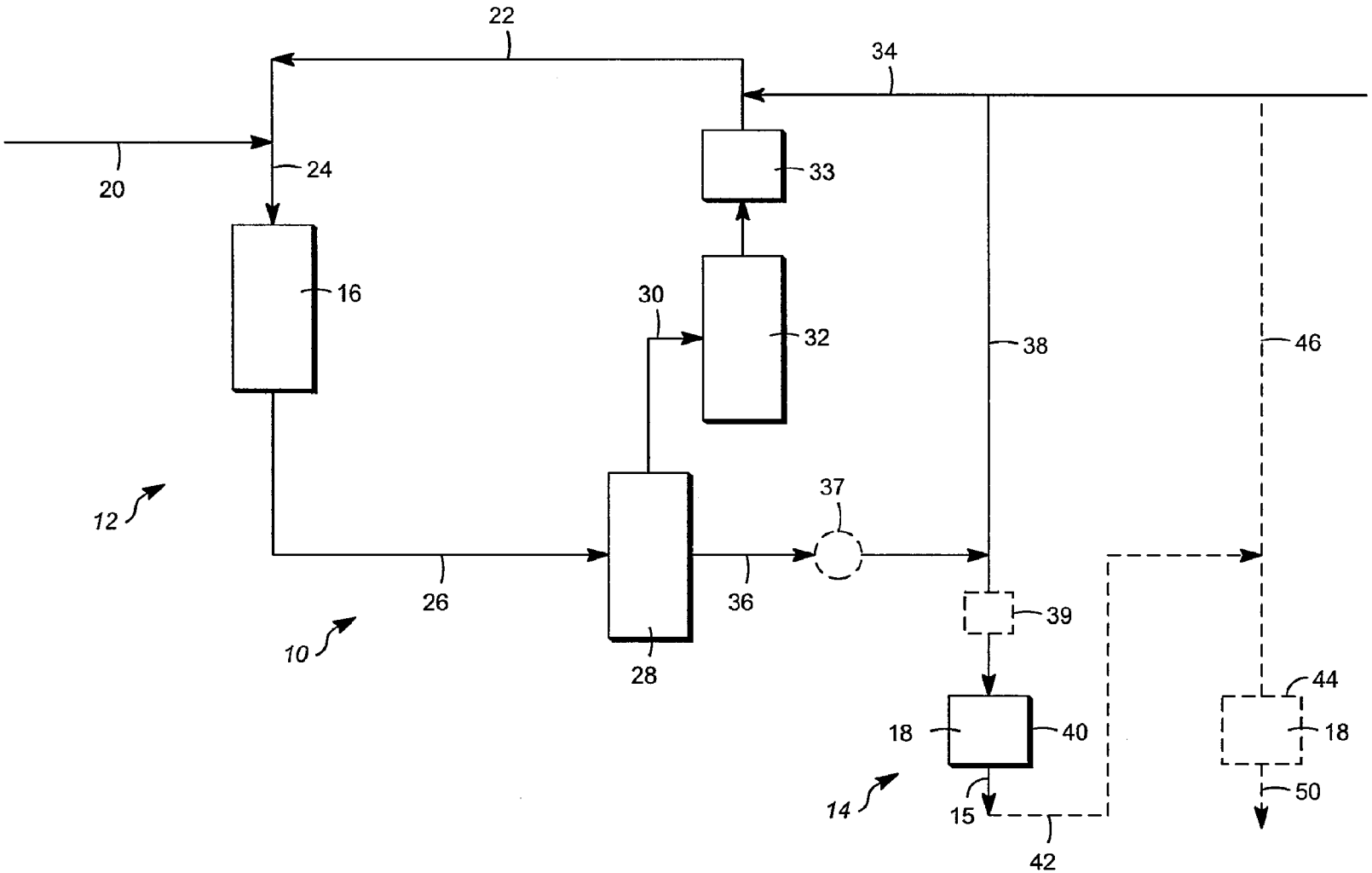
FIG. 1 is an exemplary flowchart of a process to provide low sulfur diesel with a high cetane number.

In one aspect, the processes described herein are particularly useful for providing a low or ultra low sulfur diesel with a high cetane number that separates the temperature and pressure requirements for obtaining low levels of sulfur from the temperature and pressure requirements for obtaining high cetane numbers. By one approach, a preferred process first desulfurizes a diesel boiling range distillate at low pressures to achieve the desired sulfur levels, removes a vapor phase from the low sulfur diesel, and then saturates aromatics in the low sulfur diesel at higher pressures down stream of the desulfurization zone to achieve the desired cetane number. As a result, only a smaller, downstream portion of the process is subject to the higher pressures generally needed to improve cetane.

The process, therefore, eliminates the need to upgrade (or build anew) the desulfurization zone for high pressure operation because a substantially liquid-phase reaction zone having a smaller hydrogen demand is employed downstream of the desulfurization zone and, hence, only a smaller downstream portion of the entire unit is operated at higher pressures. In such aspect, the substantially liquid-phase reaction zone is generally smaller because a vapor phase of lighter components is separated from the feed to the liquid-phase reactors. Therefore, only a portion of the hydrocarbons processed through the hydrodesulfurization zone are subsequently processed in the substantially liquid-phase reactors to improve the cetane number.

In one aspect, a suitable hydrocarbon feed stock includes a diesel boiling range distillate or a diesel boiling range hydrocarbonaceous stream having a mean boiling point of at least about 265° C. (509° F.) and generally from about 149° C. (300° F.) to about 382° C. (720° F.). Such feeds may have up to about 3 to about 4 weight percent sulfur and a cetane number generally less than about 40 (i.e., about 30 to about 40); however, other feed streams, sulfur levels, and cetane numbers can also be used in the processes herein.

In another aspect, the selected hydrocarbon feed stock is combined with a hydrogen-rich stream and then introduced into a hydrodesulfurization unit, such as a distillate hydrotreater unit, comprising a hydrotreating zone to remove hetro atoms, such as sulfur and nitrogen. For example, the hydrocarbon feed stock is first introduced into the hydrotreating zone having a hydrotreating catalyst (or a combination of hydrotreating catalysts) and operated at hydrotreating conditions effective to provide a hydrotreating zone effluent having a reduction in sulfur levels, preferably, to about 10 wppm or less. In general, such conditions include a temperature from about 260° C. (500° F.) to about 427° C. (800° F.), a pressure from about 2.4 MPa (350 psig) to about 4.8 MPa (700 psig), a liquid hourly space velocity of the fresh hydrocarbonaceous feed stock from about 0.5 $hr^{-1}$ to about 5 $hr^{-1}$. Other hydrotreating conditions are also possible depending on the particular feed stocks being treated.

At such low pressures (i.e., typically about 4.8 MPa (700 psig) or less), the hydrotreating zone effects minimal, if any, saturation of the aromatic content of the hydrocarbon feed stock. By one approach, about 15 weight percent or less of aromatics is expected to be saturated in the hydrotreating zone under such conditions. As a result, the hydrotreating zone effluent only has a minimal, if any, increase in cetane number as compared to the hydrocarbon feed stock. That is, it is expected that the hydrotreating zone effluent has only up to about a 5 cetane number improvement relative to the hydrocarbon feed stock.

Suitable hydrotreating catalysts are any known conventional hydrotreating catalysts and include those which are comprised of at least one Group VIII metal (preferably iron, cobalt and nickel, more preferably cobalt and/or nickel) and at least one Group VI metal (preferably molybdenum and tungsten) on a high surface area support material, preferably alumina. Other suitable catalysts include zeolitic catalysts, as well as noble metal catalysts where the noble metal is selected from palladium and platinum. It is within the scope of the processes herein that more than one type of catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, and preferably from about 2 to about 25 weight percent. While the above describes some exemplary catalysts, other hydrotreating catalysts may also be used depending on the particular feed stock and the desired effluent quality.

In another aspect, the effluent from the hydrotreating zone is then introduced into a separation zone. In one such aspect, the hydrotreating zone effluent may be first contacted with an aqueous stream to dissolve any ammonium salts and then partially condensed. The stream may then be introduced into a high pressure vapor-liquid separator typically operating to produce a vaporous hydrocarbonaceous stream boiling in the range from about 0° C. (30° F.) to about 32° C. (90° F.) and a liquid hydrocarbonaceous stream having a reduced concentration of sulfur and boiling in a range greater than the vaporous hydrocarbonaceous stream. By one approach, the high pressure separator operates at a temperature from about 10° C. (50° F.) to about 121° C. (250° F.) and a pressure from about 2.1 MPa (300 psig) to about 4.8 MPa (700 psig) to separate such streams.

In yet another aspect, the vapor from the separator may be directed to an amine scrubber to remove contaminates, and then back to the make-up hydrogen system and/or the hydrotreating reaction zone. Because the hydrotreating zone is operating at low pressures of 4.8 MPa (700 psig) or less, a relatively small, low-pressure recycle gas compressor may be employed. As discussed above, a costly, high-pressure recycle gas compressor is generally not needed to reintroduce the vapor from the separator back to the hydrotreating zone. The liquid hydrocarbonaceous stream from the separator then is directed to a downstream substantially liquid-phase continuous reaction zone where only the separated liquid fraction is subject to treatment at higher pressures to saturate aromatics.

The liquid hydrocarbonaceous stream from the high pressure separator (or at least a portion thereof) is then admixed with an amount of hydrogen to dissolve hydrogen therein. The liquid stream with dissolved hydrogen is then directed to the substantially liquid-phase continuous hydroprocessing or reaction zone. The liquid stream being directed to the substantially liquid-phase continuous reaction zone may optionally be drawn from the separator via pump and heated if necessary to elevate the temperature of the stream to effect the desired reactions in the liquid-phase zone.

In this aspect, the liquid hydrocarbonaceous stream from the separator (or portion thereof) is preferably undiluted with other hydrocarbon streams prior to the substantially liquid-phase continuous reaction zone so that the liquid hydrocarbonaceous stream from the separator is generally without a substantial hydrocarbon content provided from the substantially liquid-phase continuous reaction zone. That is, the substantially liquid-phase continuous reaction zone preferably does not have a hydrocarbon recycle (such as, for example, a recycle of the effluent from the liquid phase reactors), other hydrocarbon streams are not admixed into the liquid feed stream, and no hydrogen recycle is employed. Dilution of the feed to the liquid-phase reactors is generally not necessary because sufficient hydrogen can be dissolved in an undiluted stream to saturate aromatics in order to improve cetane number. As discussed above, diluting, admixing, or blending other streams into the feed to the substantially liquid-phase reactors would decrease the per pass conversion rates. As a result, the substantially undiluted feed provides for a less complex and smaller reactor system to achieve the desired saturation of aromatics.

Generally, the substantially liquid-phase continuous reaction zone is operated at liquid-phase conditions effective to sufficiently saturate aromatics to produce an effluent having an improved cetane number of at least about 40, and in other aspects, about 40 to about 60. In one aspect, the substantially liquid-phase continuous reaction zone is operated at a temperature from about 204° C. (400° F.) to about 427° C. (800° F.), a pressure from about 6.9 MPa (1000 psig) to about 10.3 MPa (1500 psig), and a liquid hourly space velocity from about 0.5 $hr^{-1}$ to about 10 $hr^{-1}$ to effect saturation of the aromatics in order to provide the improved cetane number. By one approach, it is expected about 15 to about 80 weight percent of the aromatic content in the hydrotreating zone effluent is saturated in the substantially liquid-phase continuous phase reaction zone.

The liquid-phase reaction zone preferably includes at least one Group VIII metal (preferably iron, cobalt and nickel, more preferably cobalt and/or nickel) and/or at least one Group VI metal (preferably molybdenum and tungsten) on a high surface area support material, preferably alumina. Other suitable catalysts include zeolitic catalysts, as well as noble metal catalysts where the noble metal is selected from palladium and platinum. It is within the scope of the processes herein that more than one type of catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, and preferably from about 2 to about 25 weight percent. While the above describes some exemplary catalysts, other known catalysts may also be used depending on the particular feed stock and the desired effluent quality.

In yet another aspect, an amount of hydrogen is added to the hydrotreating zone effluent or portion thereof (i.e., feed to the substantially liquid-phase continuous reactors) in excess of that required to saturate the liquid such that the substantially liquid-phase reaction zone also preferably has a small vapor phase. In one such aspect, the amount of hydrogen added to the liquid hydrocarbonaceous stream from the separator is sufficient to maintain a substantially constant level of dissolved hydrogen throughout the liquid-phase reaction zone as the reaction proceeds. Thus, as the reaction proceeds and consumes the dissolved hydrogen, there is sufficient hydrogen available from the vapor phase to continuously provide additional hydrogen to dissolve back into the liquid-phase in order to provide a substantially constant level of dissolved hydrogen (such as generally provided by Henry's law, for example). The liquid-phase, therefore, remains substantially saturated with hydrogen even as the reaction consumes dissolved hydrogen. Such a substantially constant level of dissolved hydrogen is advantageous because it provides a generally constant reaction rate in the liquid-phase reactors.

In one aspect, the amount of hydrogen added to the liquid hydrocarbonaceous stream from the separator (i.e., feed to the liquid-phase continuous reaction zone) will generally range from an amount to saturate the stream to an amount (based on the operating conditions) where the stream is generally at a transition from a liquid to a gas-phase, but still has a larger liquid-phase than a gas-phase. In one such aspect, for example, the amount of hydrogen will range from about 125 percent to about 150 percent of saturation. In other aspects, it is expected the amount of hydrogen may be up to about 500 percent of saturation and up to about 1000 percent of saturation. In one example, at the liquid-phase reaction zone conditions discussed above, it is expected that about 300 to about 400 SCF/B of hydrogen will be sufficient to maintain the substantially constant saturation of hydrogen throughout the liquid-phase reactor. This level of hydrogen can be provided by a slip stream from the hydrogen make-up system and, thus, avoids the use of costly, high-pressure recycle gas compressors. In one aspect, such amounts of hydrogen will generally provide a vapor phase in the reactor of at least about 10 percent and, in other aspects, at least about 20 percent of the reactor by volume.

In such aspect, the hydrogen will comprise a small bubble flow of fine or generally well dispersed gas bubbles rising through the liquid-phase in the reactor. In such form, the small bubbles aid in the hydrogen dissolving in the liquid-phase. In another aspect, the liquid-phase continuous system may range from the vapor phase as small, discrete bubbles of gas finely dispersed in the continuous liquid-phase to a generally slug flow mode where the vapor phase separates into larger segments or slugs of gas traversing through the liquid. In either case, the liquid is the continuous phase throughout the reactors.

Accordingly, in this aspect, the relative amount of hydrogen required to maintain a substantially liquid-phase continuous system, and the preferred additional hydrogen therein, is dependent upon the specific composition of the hydrocarbonaceous feed stock, the level or amount of saturation of the aromatics, and/or the reaction zone temperature and pressure. The appropriate amount of hydrogen required will depend on the amount necessary to keep the liquid at saturation but still maintain a liquid-phase continuous system once all of the above-mentioned variables have been selected.

Optionally, the liquid-phase reaction zone may include a plurality of liquid-phase continuous reactors in either a serial and/or parallel configuration. In a serial configuration, the effluent from one reactor is the feed to the next reactor, and in a parallel configuration, the feed is split between separate reactors. In each case, the feed stream to each reactor would have admixed hydrogen therein and, preferably, be saturated, and most preferably, have an excess amount of hydrogen therein so that each reactor has a constant amount of dissolved hydrogen throughout the reaction zone. The output from the liquid-phase continuous reaction zone is an effluent having low and, preferably, ultra low levels of sulfur with an improved cetane number.

DETAILED DESCRIPTION OF THE DRAWING FIGURE

Turning to FIG. 1, an exemplary hydrocarbon processing unit to provide low or ULSD with high cetane number will be described in more detail. It will be appreciated by one skilled in the art that various features of the above described process, such as pumps, instrumentation, heat-exchange and recovery units, condensers, compressors, flash drums, feed tanks, and other ancillary or miscellaneous process equipment that are traditionally used in commercial embodiments of hydrocarbon conversion processes have not been described or illustrated. It will be understood that such accompanying equipment may be utilized in commercial embodiments of the flow schemes as described herein. Such ancillary or miscellaneous process equipment can be obtained and designed by one skilled in the art without undue experimentation.

With reference to FIG. 1, an integrated processing unit 10 is provided that includes a hydrodesulfurization zone 12 to effect a reduction in sulfur levels at a first pressure and a subsequent or down-stream substantially liquid-phase continuous reaction zone 14 to effect saturation of aromatics at a second, higher pressure to increase the cetane number. These two zones 12 and 14 function together at different temperatures and pressures to produce a low or an ULSD output 15 (low sulfur achieved in zone 12) and, in one aspect, the anticipated cetane number of at least about 40 and, in other aspects, about 40 to about 60 (achieved in zone 14). By one approach, the hydrodesulfurization zone 12 includes at least a hydrotreating zone 16 including one or more trickle-bed reactors operating at a low pressure of about 4.8 MPa (700 psig) or less. The liquid-phase reaction zone 14 preferably includes one or more substantially liquid-phase continuous reactor vessels 18 operating within a substantially liquid system at pressures higher than the hydrotreating zone, such as about 6.9 MPa (1000 psig) or greater.

In one aspect, a feed stream, preferably comprising a diesel boiling hydrocarbonaceous stream, is introduced into the integrated process 10 via line 20. A hydrogen-rich gaseous stream is provided via line 22 and joins the feed stream 20 to produce a resulting admixture that is transported via line 24 to the hydrotreating zone 16, which preferably reduces the levels of sulfur of the hydrocarbons to about 10 wppm or less. A resulting effluent stream is removed from hydrotreating zone 16 via line 26.

The resulting effluent stream 26 is preferably cooled (not shown) and directed to a high pressure separator zone 28 where a liquid hydrocarbonaceous stream is separated from a vapor or gas stream. The gas stream is removed from the high pressure separator zone 28 via line 30 and preferably fed to an amine scrubber 32 to remove sulfur components and then to a small, low-pressure recycle gas compressor 33. Thereafter, a hydrogen rich stream may be added back to the bulk hydrogen in line 22, which is eventually added to the inlet of the hydrotreating reaction zone 16. If needed, additional hydrogen may be provided from a make-up hydrogen system via line 34.

The liquid hydrocarbonaceous stream from the separator 28 (which has low and, preferably, ultra low levels of sulfur) is directed in line 36 to the substantially liquid-phase continuous reaction zone 14. If necessary, a pump 37 may be used to transport the liquid. As discussed above, hydrogen is then admixed with the low-sulfur liquid hydrocarbonaceous stream 36 provided by a slip stream 38 from the make-up hydrogen system 34. If needed, a heater 39 may be employed to raise the temperature of the stream for reaction in the liquid-phase reactors.

In a preferred aspect, the liquid hydrocarbonaceous stream 36 is admixed with an amount of hydrogen in excess of that required for saturation. For example, the amount of hydrogen can be up to about 1000 percent over that required for saturation of the liquid hydrocarbonaceous stream 36. As a result, the amount of hydrogen is effective to permit the substantially liquid-phase continuous reaction zone 14 to operate with a substantially constant level of dissolved hydrogen (such as, for example, a hydrogen saturated liquid-phase). As the reactions consume the hydrogen, the excess hydrogen provides a small vapor phase where additional hydrogen is available to continuously re-dissolve back into the liquid-phase. In another aspect, the liquid-phase reaction zone 14 includes at least one, and optionally, two liquid-phase continuous reactors 18 connected in a serial arrangement (optional reactors are shown in hashed lines in FIG. 1).

As illustrated, if more than one reactor 18 is used in a serial arrangement, a liquid-phase effluent from a first liquid-phase reactor 40 is directed via line 42 to a second liquid-phase reactor 44. Prior to the second reactor 44, another hydrogen slip stream 46 from the hydrogen make-up system 34 is combined with line 42 to admix hydrogen therein, which in this aspect is preferably saturated, and in another aspect, has excess hydrogen above that required for saturation in a manner similar to that with the first reactor. In this case, the resulting effluent from the second reactor 44 is withdrawn as the final product via line 50 and includes low sulfur or ultra low sulfur diesel having the improved cetane number.

While FIG. 1 illustrates two liquid-phase continuous reactors 18 (i.e., reactors 40 and 44) in a serial arrangement in the reaction zone 14, it will be appreciated that this configuration is only exemplary and but one possible operating flow path in this reaction zone. Depending on the particular flow rates, desired conversions, product compositions, and other factors, the liquid-phase reaction zone can include more or less reactors in either serial and/or parallel configurations.

The foregoing description of the drawing clearly illustrates the advantages encompassed by the processes described herein and the benefits to be afforded with the use thereof. In addition, FIG. 1 is intended to illustrate but one exemplary flow scheme of the processes described herein, and other processes and flow schemes are also possible. It will be further understood that various changes in the details, materials, and arrangements of parts and components which have been herein described and illustrated in order to explain the nature of the process may be made by those skilled in the art within the principle and scope of the process as expressed in the appended claims.

What is claimed is:

1. A process for producing low sulfur diesel having a high cetane number, the process comprising:

providing a diesel boiling range hydrocarbon stream with a sulfur content, a cetane number, and an aromatic content;

converting the diesel boiling range hydrocarbon stream in at least a hydrotreating zone having at least a hydrodesulfurization catalyst at hydrotreating conditions effective to produce a hydrotreating zone effluent having a reduced sulfur content relative to the sulfur content of the diesel boiling range hydrocarbon stream;

taking at least a portion of the hydrotreating zone effluent as a hydroprocessing feed;

admixing hydrogen with the hydroprocessing feed in an amount and in a form available for substantially consistent consumption in the liquid-phase continuous hydroprocessing reaction zone; and reacting the hydroprocessing feed substantially undiluted with another hydrocarbon stream in the substantially liquid-phase continuous hydroprocessing zone over a catalyst and at conditions effective to saturate at least a portion of the aromatic content therein to provide a liquid-phase continuous hydroprocessing zone effluent having an increased cetane number relative to the diesel boiling range hydrocarbon stream.

2. The process of claim 1, wherein the hydrotreating zone effluent has a cetane number less than about 40.

3. The process of claim 1, wherein the liquid-phase continuous reaction zone effluent has a cetane number greater than about 40.

4. The process of claim 1, wherein the reaction proceeds in the substantially liquid-phase continuous hydroprocessing zone without additional sources of hydrogen external to the liquid-phase continuous hydroprocessing zone.

5. The process of claim 4, wherein the substantially liquid-phase continuous hydroprocessing zone has a substantially constant amount of dissolved hydrogen throughout the hydroprocessing zone effective to produce a substantially constant reaction rate.

6. The process of claim 5, wherein the hydroprocessing feed is admixed with an amount of hydrogen in excess of that required for saturation of the hydroprocessing feed.

7. The process of claim 6, wherein the amount of hydrogen added to the hydroprocessing feed is up to about 1000 percent over that required for saturation of the hydroprocessing.

8. The process of claim 7, wherein the hydrogen is provided from a make-up hydrogen system.

9. The process of claim 1, wherein a pressure in the substantially liquid-phase continuous hydroprocessing zone is higher than a pressure in the hydrotreating zone.

10. A process for producing low sulfur diesel having a high cetane number, the process comprising:

providing a diesel boiling range hydrocarbon stream with a sulfur content, a cetane number, and an aromatic content;

converting the diesel boiling range hydrocarbon stream in at least a hydrotreating zone having at least a hydrodesulfurization catalyst at hydrotreating conditions effective to produce a hydrotreating zone effluent having a reduced sulfur content relative to the diesel boiling range hydrocarbon stream;

admixing hydrogen with the hydrotreating zone effluent in an amount and in a form available for substantially consistent consumption in a liquid-phase continuous reaction zone, the hydrotreating zone effluent substantially undiluted with other hydrocarbon streams; and reacting the hydrotreating zone effluent substantially undiluted with another hydrocarbon stream in a substantially liquid-phase continuous reaction zone over a catalyst and at conditions effective to saturate at least a portion of the aromatic content therein to provide a liquid-phase continuous reaction zone effluent having an increased cetane number relative to the diesel boiling range hydrocarbon stream.

11. The process of claim 10, wherein the hydrotreating zone effluent has a cetane number less than about 40 and wherein the liquid-phase continuous reaction zone effluent has a cetane number greater than about 40.

12. The process of claim 11, wherein the reaction proceeds in the substantially liquid-phase continuous reaction zone without additional sources of hydrogen external to the liquid-phase continuous reaction zone.

13. The process of claim 11, wherein the hydrotreating zone effluent is admixed with an amount of hydrogen in excess of that required for saturation of the hydrotreating zone effluent.

14. A process for producing low sulfur diesel having a high cetane number, the process comprising:

providing a hydrocarbon feed with a boiling range from about 149° C. (300° F.) to about 382° C. (720° F.), a sulfur content, an aromatic content, and a cetane number;

reacting the hydrocarbon feed in at least a hydrotreating zone having at least a hydrodesulfurization catalyst at a pressure of about 4.8 MPa (700 psig) or less to produce a hydrotreating zone effluent having a reduced sulfur content relative to the hydrocarbon feed;

admixing an amount of hydrogen in excess of that required for saturation into the hydrotreating zone effluent to provide at least a hydrogen saturated hydrotreating zone effluent;

directing the hydrotreating zone effluent to a generally liquid-phase continuous reaction zone, the hydrotreating zone effluent substantially undiluted with another hydrocarbon stream; and reacting the substantially undiluted hydrotreating zone effluent in the generally liquid-phase continuous reaction zone over a catalyst and at a pressure of about 6.9 MPa (1000 psig) or greater effective to saturate at least a portion of the aromatic content therein to provide a liquid-phase continuous reaction zone effluent having a cetane number greater than about 40.

15. The process of claim 14, wherein less than about 15 weight percent of the aromatic content is saturated in the hydrotreating zone.

16. The process of claim 14, wherein the hydrotreating zone effluent has about 10 wppm or less of sulfur.

17. The process of claim 14, wherein the reaction proceeds in the generally liquid-phase continuous reaction zone without additional sources of hydrogen external to the generally liquid-phase continuous reaction zone.

18. The process of claim 17, wherein the generally liquid-phase continuous reaction zone has a substantially constant amount of dissolved hydrogen throughout the reaction zone effective to produce a substantially constant reaction rate.

19. The process of claim 14, wherein the amount of hydrogen admixed into the hydrotreating zone effluent is up to about 1000 percent over that required for saturation.

20. The process of claim 14, wherein the hydrogen is provided from a make-up hydrogen stream at a pressure of at least about 6.9 MPa (1000 psig).

* * * * *